US007055193B2

(12) United States Patent
Macari et al.

(10) Patent No.: US 7,055,193 B2
(45) Date of Patent: Jun. 6, 2006

(54) BED GUARD ASSEMBLY

(75) Inventors: Jason Macari, Lincoln, RI (US); Steven Gibree, Foster, RI (US)

(73) Assignee: Summer Infant, Inc., Slatersville, RI (US)

( * ) Notice: Subject to any disclaimer, the term of this patent is extended or adjusted under 35 U.S.C. 154(b) by 0 days.

(21) Appl. No.: 11/078,197

(22) Filed: Mar. 11, 2005

(65) Prior Publication Data

US 2005/0246837 A1 Nov. 10, 2005

Related U.S. Application Data

(63) Continuation-in-part of application No. 10/755,704, filed on Jan. 12, 2004, now Pat. No. 6,959,463, which is a continuation-in-part of application No. 10/285,331, filed on Oct. 31, 2002, now Pat. No. 6,725,476.

(60) Provisional application No. 60/647,185, filed on Jan. 25, 2005, provisional application No. 60/411,307, filed on Sep. 17, 2002.

(51) Int. Cl.
*A47C 21/08* (2006.01)

(52) U.S. Cl. ..... 5/425; 5/426

(58) Field of Classification Search ..... 5/425–429, 5/93.2, 95, 512

See application file for complete search history.

(56) References Cited

U.S. PATENT DOCUMENTS

| | | | | |
|---|---|---|---|---|
| 2,649,594 | A * | 8/1953 | Herz et al. | 5/425 |
| 2,667,647 | A * | 2/1954 | Reggiani | 5/95 |
| 2,722,693 | A * | 11/1955 | Wolf | 5/426 |
| 2,751,608 | A | 6/1956 | Lucas | |
| 3,289,223 | A | 12/1966 | Oja et al. | |
| 3,290,701 | A | 12/1966 | Luff | |
| 3,474,473 | A | 10/1969 | Hannaberg | |
| 4,178,645 | A | 12/1979 | Cosme | |
| 4,833,743 | A | 5/1989 | Howell et al. | |
| 5,038,430 | A | 8/1991 | Bly | |
| 5,437,067 | A | 8/1995 | Bernstein et al. | |
| 5,463,784 | A | 11/1995 | Alpern | |
| 5,519,905 | A | 5/1996 | Bernstein et al. | |
| 5,577,277 | A | 11/1996 | Sundberg et al. | |
| 5,596,776 | A | 1/1997 | Huang | |
| 5,640,726 | A | 6/1997 | Fichner-Rathus | |
| 6,134,731 | A | 10/2000 | Thom et al. | |
| 6,453,490 | B1 | 9/2002 | Cardinale | |
| 6,725,476 | B1 * | 4/2004 | Macari | 5/426 |
| 6,728,981 | B1 | 5/2004 | Gutierrez | |
| 6,952,847 | B1 * | 10/2005 | Cleary | 5/430 |
| 6,959,463 | B1 * | 11/2005 | Macari | 5/425 |
| 2004/0168251 | A1 | 9/2004 | Waldman et al. | |

FOREIGN PATENT DOCUMENTS

| | | |
|---|---|---|
| GB | 2070921 A | 9/1981 |
| GB | 2225716 A | 6/1990 |

* cited by examiner

*Primary Examiner*—Michael Trettel
(74) *Attorney, Agent, or Firm*—IP Strategies

(57) ABSTRACT

A bed guard assembly includes one or more side panels, an end panel coupled to the one or more side panels, and stabilizers for placement beneath a mattress, coupled to the one or more side panels. Each side panel includes a rigid outer side frame and fabric material attached to the rigid outer side frame. The end panel includes a rigid outer end frame and fabric material attached to the rigid outer end frame. Each side panel and/or the end panel can also include a substantially horizontal rigid member spanning an interior of the outer side frame.

53 Claims, 8 Drawing Sheets

BED GUARD ASSEMBLY

CROSS-REFERENCE TO RELATED APPLICATIONS

This is a continuation-in-part of U.S. patent application Ser. No. 10/755,704, which was filed on Jan. 12, 2004, now U.S. Pat. No. 6,959,463, which in turn was a continuation-in-part of U.S. patent application Ser. No. 10/285,331, now U.S. Pat. No. 6,725,476, which was filed on Oct. 31, 2002, and which in turn was based on U.S. Provisional Patent Application Ser. No. 60/411,307, which was filed on Sep. 17, 2002. This is also based on U.S. Provisional Patent Application Ser. No. 60/647,185, which was filed on Jan. 25, 2005.

BACKGROUND OF THE INVENTION

The present invention relates to guard assemblies for beds, used to prevent an occupant of the bed from falling off the bed.

Bed guard assemblies, such as side rails, are well known. These assemblies are useful in several applications. For example, small children making the transition from sleeping in an enclosed crib to sleeping on an open bed often need a barrier to prevent a fall onto the floor while sleeping. Use of such barriers on the top bunk of a set of bunk beds also prevents a child from inadvertently falling during the night. Often, bed-ridden adults, such as hospital patients, require such a barrier also. Beds on moving platforms, such as trains and ships, often use such restraints, as do beds on submarines and in other environments in which tight quarters require a narrow sleeping space. Conventionally, these rails are placed on the sides of the bed only, but can also be placed at the head and foot of the bed, if the frame and headboard do not provide a sufficient barrier.

Conventional bed guard assemblies provide the obstruction needed for any of these applications, but usually have one or more disadvantages. For example, many systems can be large and bulky, making assembly and disassembly difficult, and storage impractical. These systems are usually disposed under the mattress or attached directly to the bed using means that are similarly complicated and unwieldy. Simpler systems have been devised, but these tend not to be as sturdy or durable. Others provide hard, heavy impediments that could actually hurt a child when bumped, and over time might also damage the bed. What is needed is a secure bed guard that is easy to attach to and detach from the bed, that is compact for storage, and that provides a safe barrier for a child.

BRIEF SUMMARY OF THE INVENTION

The present invention is a bed guard apparatus that attaches to a bed and provides a secure barrier against falling out of the bed. The apparatus includes panels that act as the barriers, and which are connected together, for example, below the mattress and/or at common ends. The panels can be oriented so as to face each other across the mattress space, or can provide a barrier at an end of the bed in addition to at either side or both sides of the bed. The connection system is adjustable to adapt to any size bed, and provides for quick and easy implementation. When not in use, the apparatus is compact and easy to store.

Thus, according to an aspect of the present invention, a bed guard assembly includes one or more side panels, an end panel coupled to the one or more side panels, and stabilizers for placement beneath a mattress, coupled to the one or more side panels. Each side panel includes a rigid outer side frame and fabric material attached to the rigid outer side frame. The end panel includes a rigid outer end frame and fabric material attached to the rigid outer end frame. Each side panel and/or the end panel can also include a substantially horizontal rigid member spanning an interior of the outer side frame.

The rigid outer frame of the side panel(s) and/or end panel can include substantially parallel opposing top and bottom members connected to substantially parallel opposing side members. The substantially horizontal rigid member can be coupled to the substantially parallel opposing side members. The substantially parallel opposing top and bottom members and the substantially horizontal rigid member can each include a pair of removably connected rigid tubes. Each pair of removably connected rigid tubes can be slidably coupled together.

The assembly can also include fasteners that fix a relative position of the respective pairs of removably connected rigid tubes in order to fix a length of the substantially parallel opposing top and bottom members and of the substantially horizontal rigid member. For example, the fasteners can include first fastener portions coupled to first tubes of each pair of removably connected rigid tubes, and second fastener portions coupled to second tubes of each pair of removably connected rigid tubes, which mate with corresponding first fastener portions to fix a relative position of the respective pairs of removably connected rigid tubes.

Alternatively, the fasteners can be coupled to first tubes of each pair of removably connected rigid tubes, and second tubes of each pair of removably connected rigid tubes can include apertures that communicate with the fasteners to fix a position of the first tubes of each pair of removably connected rigid tubes with respect to the second tubes of each pair of removably connected rigid tubes. In the latter example, each fastener can include a spring portion and a button. The spring portion can provide a bias that pushes the button through a respective aperture in the second tube of the pair of removably connected rigid tubes to fix a length of the pair of removably connected rigid tubes. For example, the fastener can be a Valco®-type snap button.

Preferably, the length of the substantially parallel opposing top and bottom members and of the optional substantially horizontal rigid member of the side panel(s) is adjustable in a range of 30 inches to 48 inches. Likewise, the length of the substantially parallel opposing top and bottom members and of the optional substantially horizontal rigid member of the end panel is preferably adjustable in a range of 30 inches to 56 inches.

An embodiment of the bed guard assembly can include a single side panel. In this case, the stabilizers can include at least one rigid side extension that extends from a bottom end of the side panel at a substantially right angle to a plane defined by the rigid outer side frame. This embodiment can also include at least one rigid end extension that extends from a bottom end of the end panel at a substantially right angle to a plane defined by the rigid outer end frame.

According to another embodiment having a single side panel, the stabilizers can include at least one base element, and flexible connecting material attached to the base element such that the side panel opposes the base element when the flexible connecting material is disposed beneath a mattress. The stabilizers can also include a mechanism for decreasing the length of flexible connecting material disposed between the base element and the side panel, to reduce slack in the flexible connecting material such that the base element is pulled taut against a side of the mattress opposing the side panel. For example, the mechanism can be a buckle. This embodiment can also include at least one rigid end extension that extends from a bottom end of the end panel at a substantially right angle to a plane defined by the rigid outer end frame.

According to another embodiment having a single side panel, the bed guard assembly can also include an upright post that couples the end panel to the side panel. The upright post can provide a hinged connection between the end panel and the side panel. For example, the end panel and the side panel can be oriented at a substantially right angle when the hinged connection is in an open position. This embodiment can also include a number of spacers. Each spacer can be attached to the upright post and to either the end panel or the side panel so as to maintain a fixed distance between the upright post and the panel to which it is attached. The spacers provide clearance such that the end panel and the side panel can be oriented in substantially parallel planes when the hinged connection is in a closed position.

Another embodiment of the bed guard assembly can include a first side panel and a second side panel. For example, a first side of the first side panel can be coupled to a first side of the end panel and a first side of the second side panel can be coupled to a second side of the end panel. According to this embodiment, the stabilizers can include at least one first rigid side extension that extends from a bottom end of the first side panel at a substantially right angle to a plane defined by the first rigid outer side frame, and at least one second rigid side extension that extends from a bottom end of the second side panel at a substantially right angle to a plane defined by the second rigid outer side frame. Each first rigid side extension can be connected to a respective second rigid side extension, so that the side frames are stable and connected. This embodiment can also include at least one rigid end extension that extends from a bottom end of the end panel at a substantially right angle to a plane defined by the rigid outer end frame.

This embodiment can also include a first upright post that couples the end panel to the first side panel, and a second upright post that couples the end panel to the second side panel. The first and second upright posts can provide hinged connections between the end panel and the respective side panels. For example, the end panel can be oriented at a substantially right angle with the first side panel and/or the second side panel when the corresponding hinged connection is in an open position. The bed guard assembly can also include a number of spacers. Each spacer can be attached to either the first upright post or the second upright post and to either the end panel, the first side panels, or the second side panel so as to maintain a first fixed distance between the respective upright post and the end panel, a second fixed distance between the first upright post and the first side panel, and a third fixed distance between the second upright post and the second side panel. The end panel and the first and second side panels can be oriented in substantially parallel planes when the hinged connections are in a closed position. To facilitate folding the assembly in this manner, either the second fixed distance or the third fixed distance can be greater than the other.

According to this embodiment, the bed guard assembly can also include a third upright post coupled to a second side of the first end panel, and a fourth upright post coupled to a second side of the second end panel. In this case, the stabilizers can be coupled to the first and second side panels by direct connection to the third and fourth upright posts. For example, the stabilizers can include a first flexible connection piece connected to the third upright post, and a second flexible connection piece connected to the fourth upright post. The bed guard assembly of this embodiment can also include at least one coupler attached to an end of the first flexible connection piece and/or the second flexible connection piece. For example, the coupler can be a buckle.

The third and fourth upright posts can include respective first and second footings extending from the bottoms of the third and fourth upright posts at substantially right angles to the third and fourth upright posts, and the stabilizers can be connected to the first and second footings. The third and fourth upright posts can have hinged connections to the first and second side panels, respectively. For example, each footing can be oriented at a substantially right angle with the respective coupled side panel when the corresponding hinged connection is in an open position. Likewise, each footing can be oriented in a substantially parallel plane with the respective coupled side panel when the corresponding hinged connection is in a closed position.

DETAILED DESCRIPTION OF THE INVENTION

Figure 1:
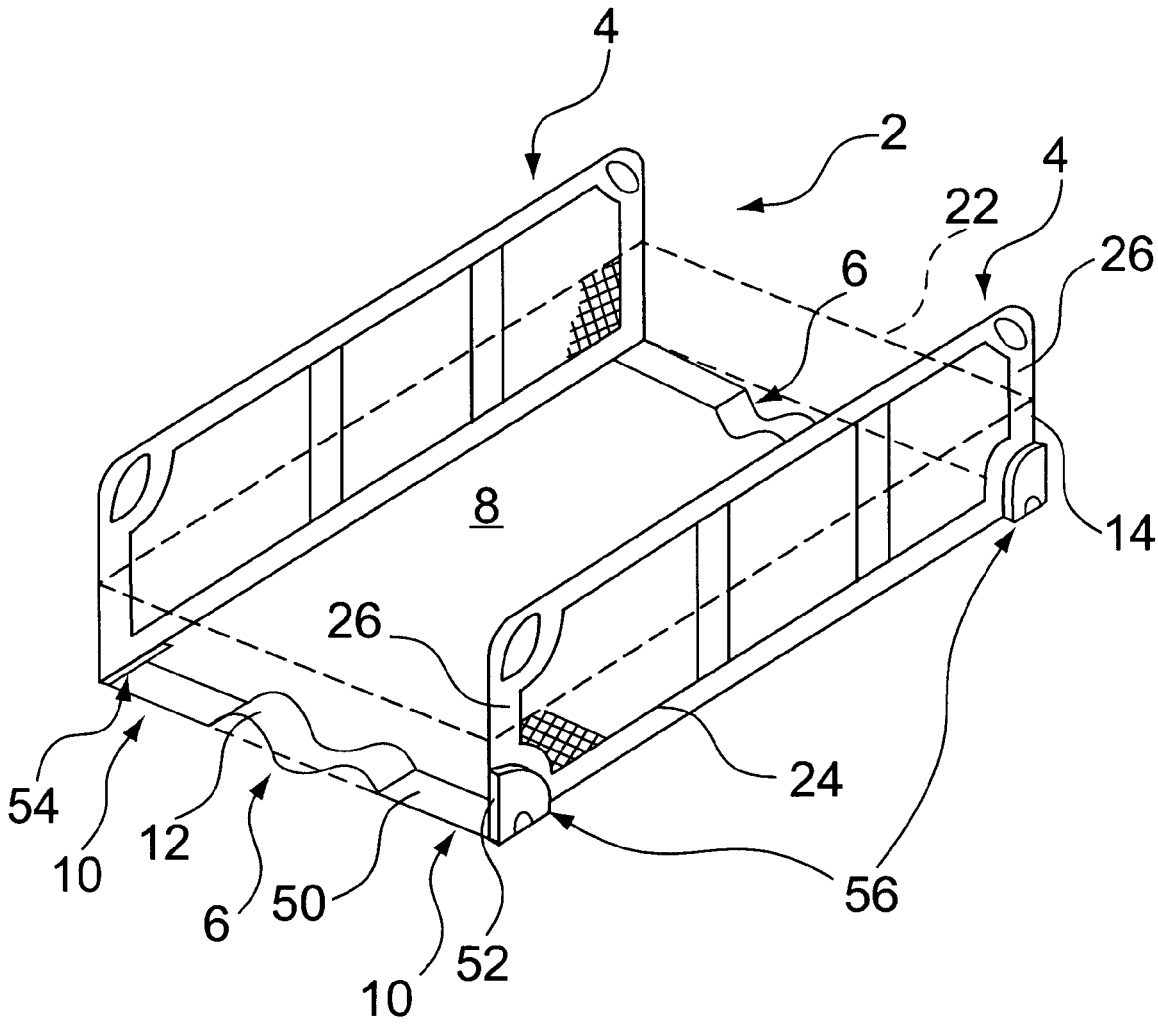
FIG. 1 is a diagram of a first exemplary embodiment of the present invention.

FIG. 1 shows a first exemplary embodiment of the bed guard assembly 2 of the present invention. This embodiment includes two side panels 4, flexible connecting material 6 for placement beneath a mattress 8, and connection pieces 10. As shown, the connection pieces 10 connect the flexible connecting material 6 to the side panels 4 such that at least one side panel opposes another side panel when the flexible connecting material 6 is disposed beneath a mattress 8. The flexible connecting material 6 can rest on a box spring located beneath the mattress 8, directly on the bed fame surface, on slats supporting the mattress 8, or on any other bedding element that might be present in the bedding configuration. Preferably, the side panels 4 extend vertically above the upper surface of the mattress 8.

The flexible connecting material 6 can include strips of webbing 12. As shown in FIG. 1, an exemplary embodiment includes two strips of webbing 12 material, connected to ends of the side panels 4. The strips of webbing 12 can be made of suitable material that is durable and flexible, such as nylon.

Figure 2:
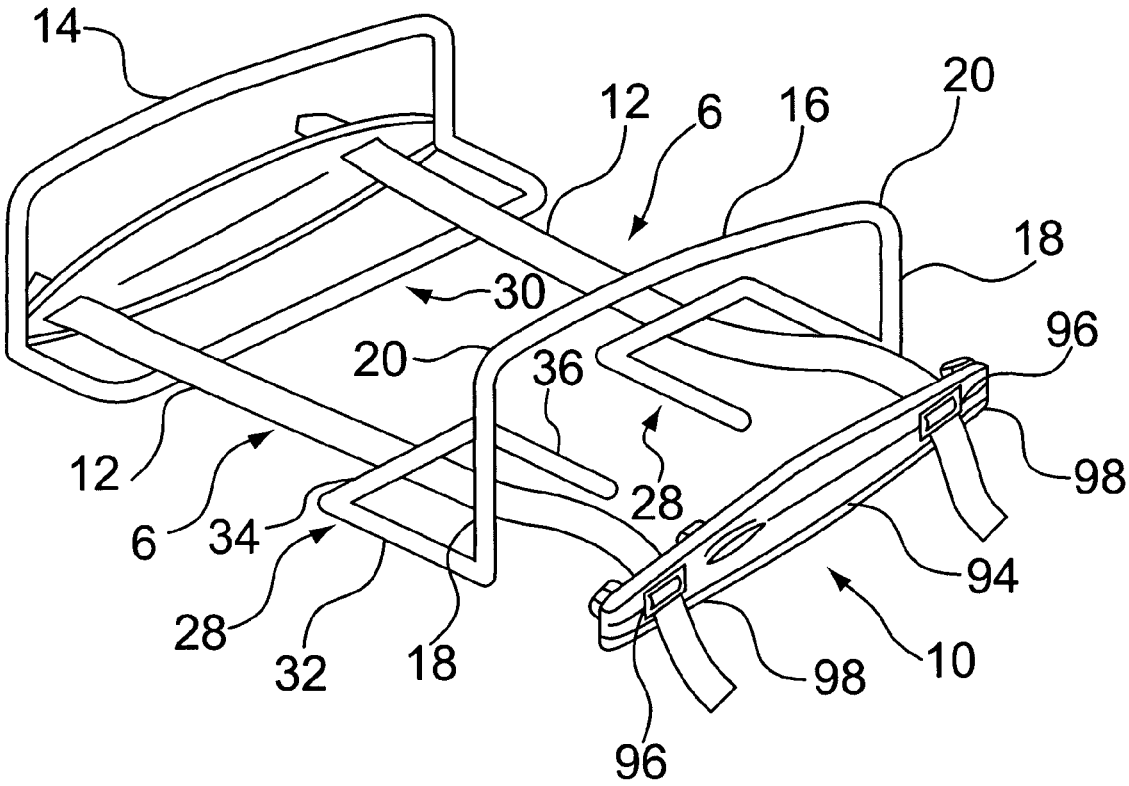
FIG. 2 is a diagram of a second exemplary embodiment of the present invention.

As shown, the exemplary side panels 4 include a rigid outer frame 14. This frame 14 can be made of any rigid, durable material. For example, the frame 14 can be constructed of hard plastic or PVC, or of metal, such as steel or aluminum. As shown in FIG. 2, the rigid outer frame 14 can be made from removably connected rigid tubes. These tubes can have ends with different cross-sectional diameters, so that each rigid tube can be fitted to adjacent rigid tubes by sliding the larger diameter end over a smaller diameter end. These tubes can be friction fitted for attachment, or can be fixed in place through the use of spring buttons or other fasteners.

The rigid outer frame 14 can be constructed as a unitary piece, or from a number of components, such as a top member 16, two side members 18, and two corner members 20 attaching respective side members 18 to opposite ends of the top member 16, as shown in FIG. 1. Alternatively, the rigid outer frame 14 can include substantially parallel opposing top and bottom portions 22, 24 connected to substantially parallel opposing side portions 26, and can have rounded corners at connections of the top piece with the side pieces, as shown in FIG. 1. In any case, the rigid outer frame 14 can include a number of segments 32, 34, 36 that are removably attached to each other, for easy disassembly and storage.

Figure 6:
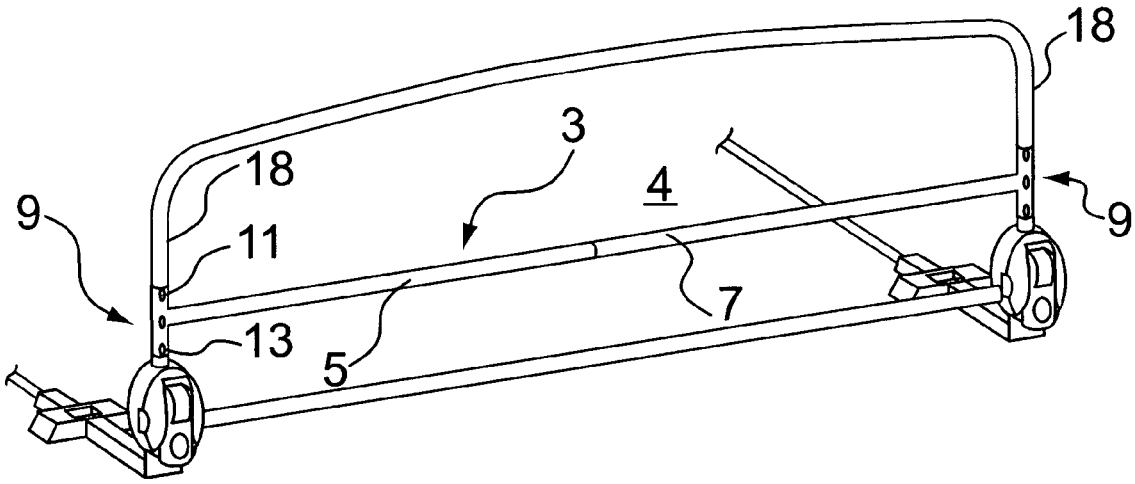
FIG. 6 is a diagram of an outer frame of an end panel having an additional horizontal segment.

As shown in FIG. 6, one or more side panels 4 can also include a horizontal member 3, which can add stability to the panel, and can provide an added protective barrier. The horizontal member 3 can be constructed, for example, of two or more slidably attached tubular segments 5, 7. As shown, the horizontal member 3 can be coupled to the side members 18. In particular embodiments, the horizontal member 3 will be slidably coupled to the side members 18. For example, the end portions 9 of the horizontal member 3 can be tubes that slide over the respective side members 18.

Figure 7:
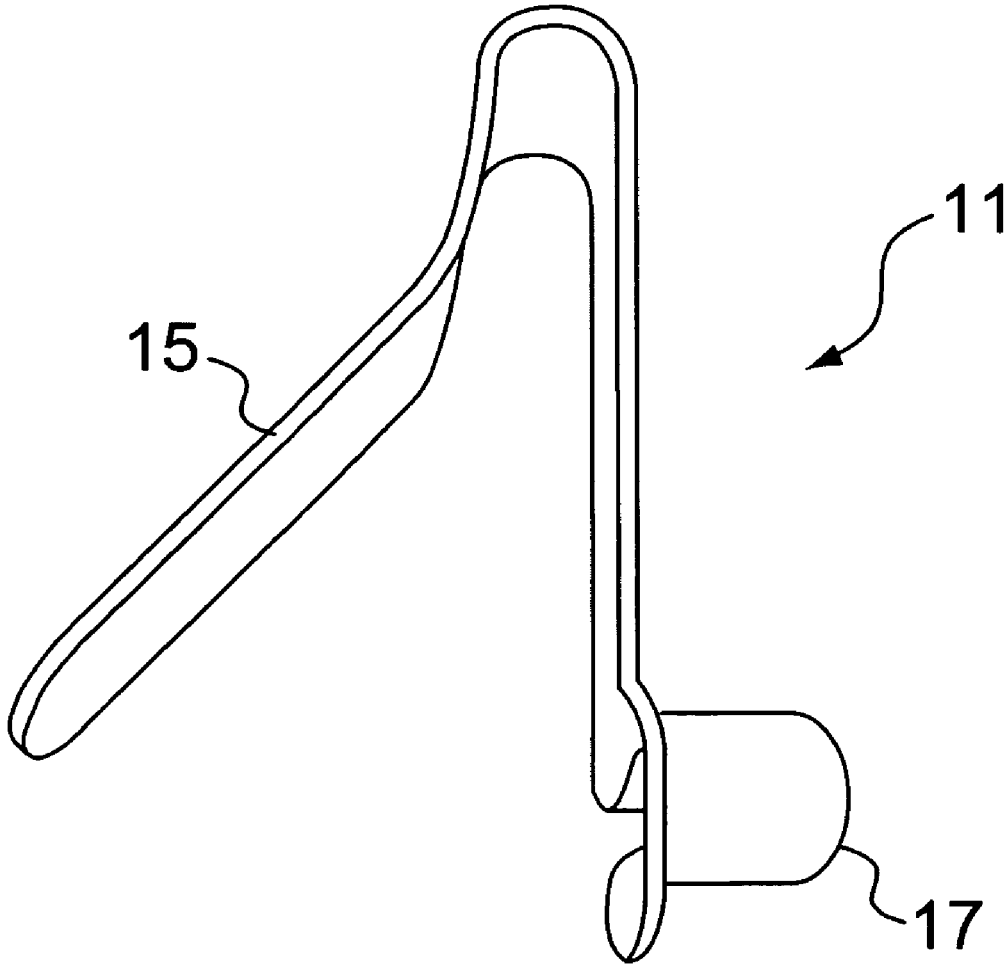
FIG. 7 is an illustration of an exemplary fastener.

With reference to FIG. 7, the bed guard assembly 2 can include fasteners 11 that fix the position of the horizontal member 3 with respect to the side members 18. The height of the horizontal member 3 can be made adjustable by providing a number of fasteners 11 on the side members 18, and selecting fasteners 11 corresponding to the desired height of the horizontal member 3 to secure the attachment. These fasteners can be of a mating-pair type, for example, in which a first portion of the fastener is attached to the side members 18, and the second, mating portion is attached to the horizontal member 3. Alternatively, fasteners on the side members 18 can mate with holes 13 in the ends of the horizontal member 3 to fix the chosen position.

In a particular preferred embodiment, fasteners 11 are coupled to the insides of the side members 18. The side members 18 can include holes 13 through which the fasteners 11 can mate with holes 13 in the end portions 9 of the horizontal member 3. If the end portions 9 of the horizontal member 3 include a number of holes 13, as shown, the height of the horizontal member 3 can be chosen by selecting the mating holes 13 accordingly. A fastener 11 that can be used advantageously with this embodiment includes a spring portion 15 and a button 17, as shown in FIG. 7. The spring portion 15 provides a bias that pushes the button 17 through the hole 13 in the side members 18 and through the selected hole 13 in the end portions 9 of the horizontal member 3 to hold the horizontal member 3 in place. Depressing the button 17 allows the horizontal member 3 to be moved to a different position, where it can be fixed in place by releasing the button 17. An example of a commercial fastener of this type is a Valco® snap button.

The embodiment shown in FIG. 1 also has at least one extension 28, 30 that extends at a substantially right angle to a plane defined by the top portion 22 and the first and second side portions 26. For example, the frame 14 can include two extensions 28, one each attached to the first and second side portions 26, or a single extension 30 attached to the frame 14 at both side portions 26. Like the rest of the frame 14 shown in FIG. 2, each extension 28, 30 includes a number of connected segments 32, 34, 36. For example, the extensions 28 can each include three segments 32, 34, 36 that can be connected to form three sides of a rectangle, as shown, connected by one of the segments 32, 34, 36 to a side portion of the rigid outer frame 14 to form the extension 28. If there is only one extension 30, a second segment can be connected to the other side portion of the rigid outer frame 14. In any case, the extension(s) 28, 30 provide a base that allows the side panel to stand upright.

Figure 3:
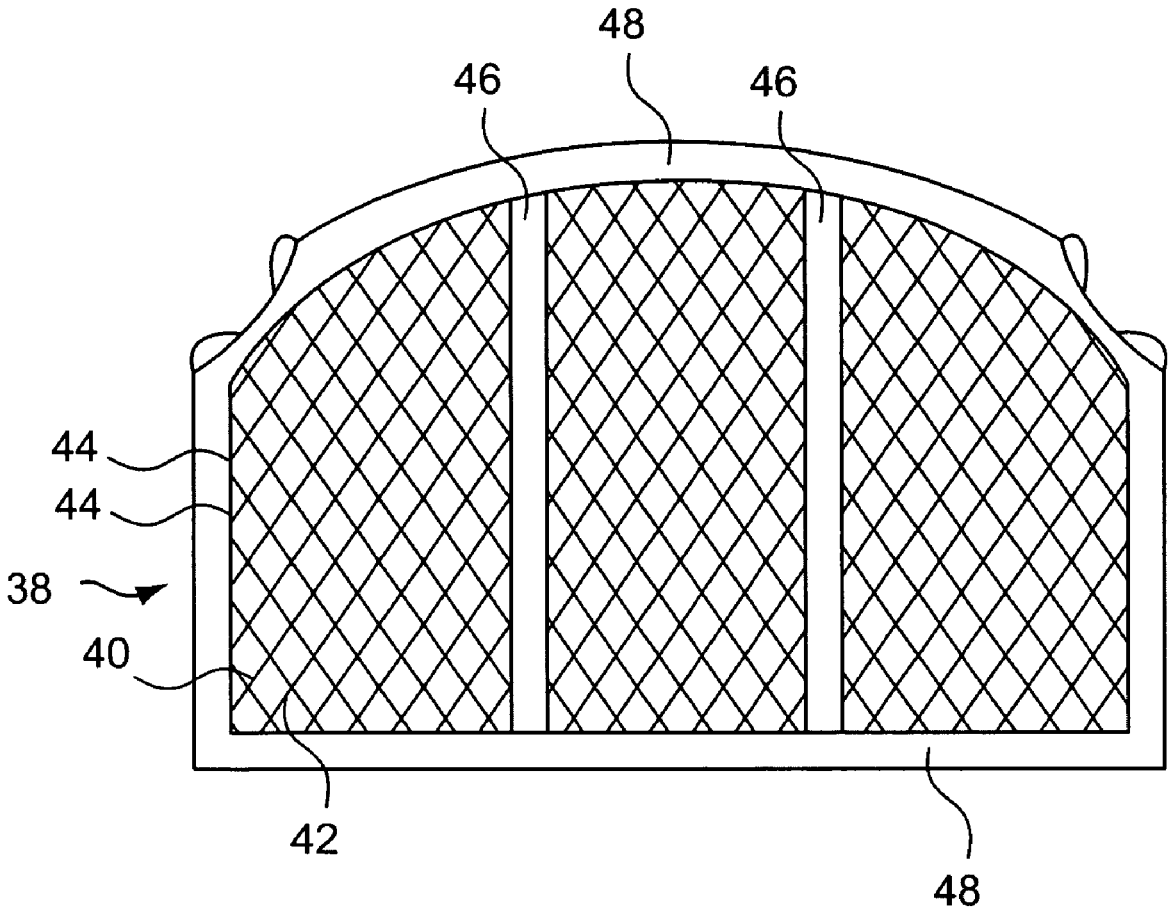
FIG. 3 is a diagram of an exemplary end panel of the present invention.

An exemplary side panel of the present invention is shown in FIG. 3. As shown in FIG. 1, the side panel includes a fabric portion 38 framed by the rigid outer frame 14. The fabric portion 38 can include netting 40, which in turn can be made from a mesh material 42 having openings 44 of any appropriate size, for example, between about 0.25 inches and about 2 inches. The fabric portion 38 can include one or more stabilizing straps 46 spanning the fabric portion 38, to provide more durability over the span of the fabric portion 38. The stabilizing straps 46 can be made of any flexible, strong material, such as nylon.

The fabric portion 38 can also include a border 48, which also can be made of nylon, around its outer periphery, and the stabilizing straps 46 can be attached to the netting 40 and to the nylon border 48, for example, at top and bottom ends of the fabric portion 38 as shown. Alternatively, the stabilizing straps 46 can be attached to the netting 40 and to top and bottom portions 22, 24 of the rigid outer frame 14 itself. The nylon border 48 can include a sleeve that accepts components of the rigid outer frame 14. For example, given the tubular construction of the frame 14 shown in FIG. 2, the individual top and side tubes can be inserted into the border sleeves and connected. Thus, when the frame 14 is complete, the fabric portion 38 is held in place by the border 48.

Another way that the fabric portion 38 can be removably attached to the rigid outer frame 14 is by fitting the fabric portion 38 over the rigid outer frame 14. In this case, the fabric portion 38 can be made from a stretch material that provides a tension fit with the rigid outer frame 14. Alternatively, the fabric portion 38 can be attached to the frame 14 through the use of fasteners, which attach to the frame 14 itself, or which attach to other fasteners on the fabric portion 38 after, for example, wrapping the frame 14. These fasteners can be, for example, snaps, or hook and loop fasteners such as Velcro®.

The connection pieces 10 preferably are rigid structures, constructed to form a substantially right angle 54 with the respective connected end panel The connection pieces 10 can be fixed to the side panels 4 and to the connecting material 6, or they can be removably attached. For example, the connection pieces 10 can be attached to the side panels 4 by a connection mechanism that provides the removable attachment. Alternatively, the connection pieces 10 can be simple articles, such as a rigid footing 50 attached to the connecting material 6.

Alternatively, the connection pieces 10 can be an angled joint 52 connected between the connecting material 6 and the side panels 4, preferably removably attached. The angled joint 52 can be adjustable, and can have a number of fixed stops. For example, the adjustable angled joint 52 can have a stop fixed at a substantially right angle 54, and other stops to fix the relative position at other useful angles. The range of adjustability of the angled joint 52 preferably allows the end that is attached to the connecting material 6 to be folded against the side panel, providing a low profile for storage.

Figure 4:
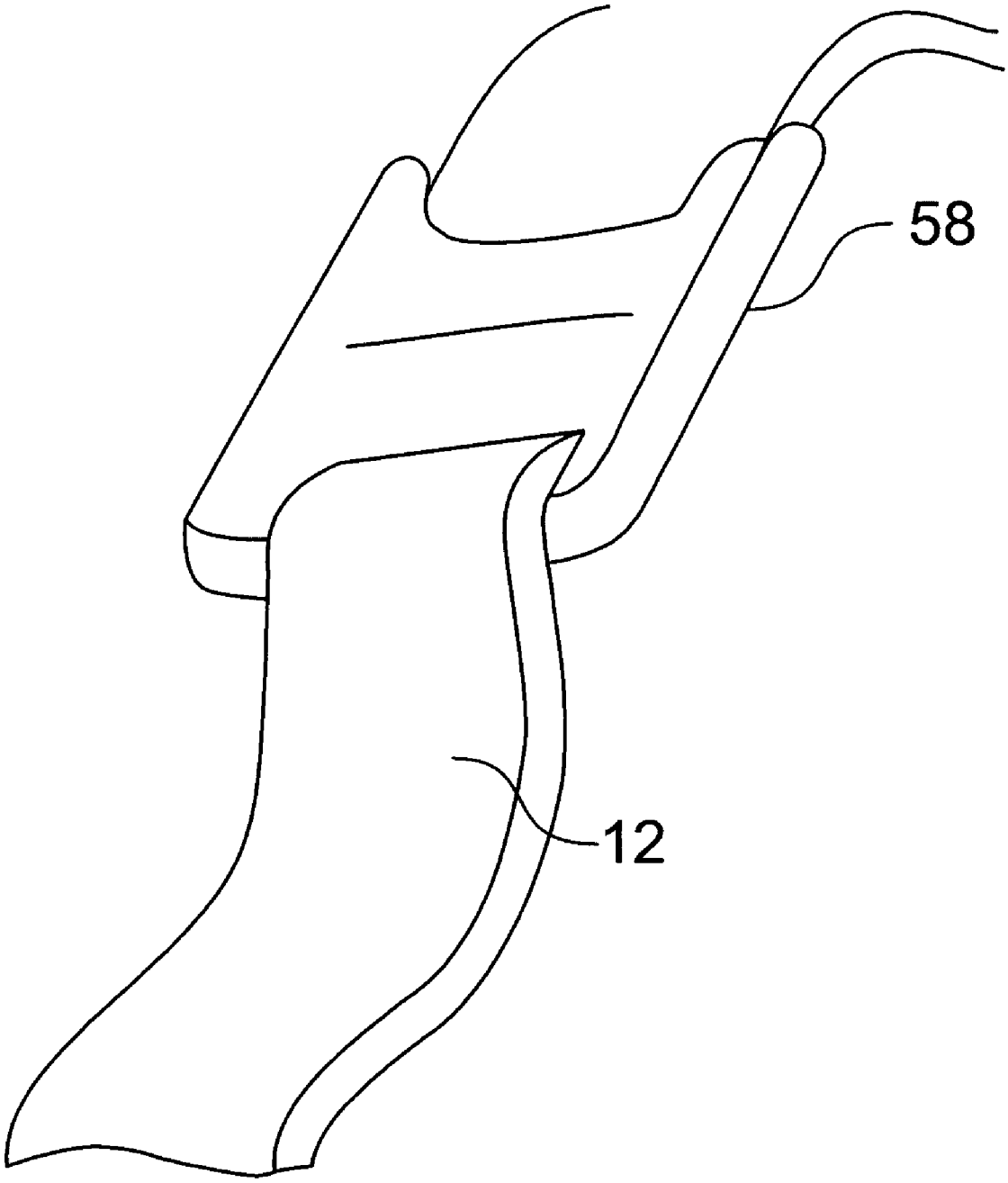
FIG. 4 is a diagram of a first exemplary adjustment mechanism of the present invention.

The connection pieces 10 can also include an adjustment mechanism, such as a mechanism for decreasing the length of connecting material 6 disposed between the end panels 4, or for reducing an amount of slack of connecting material 6 disposed between the side panels 4 when the side panels 4 are disposed in fixed positions or when the connecting material 6 is disposed beneath the mattress 8 and the side panels 4 are placed against opposite sides of the mattress 8. For example, the mechanism 56 can be a buckle 58 or similar device that is well known to those of skill in the art. An example of such a buckle 58 is shown in FIG. 4.

Figure 5A:
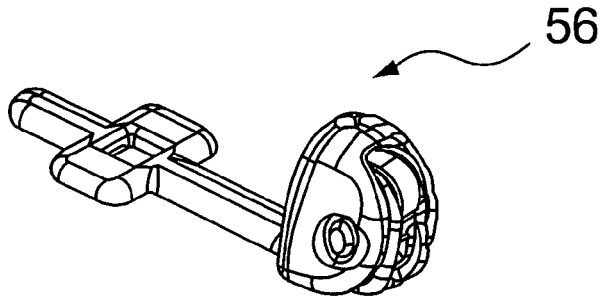
FIG. 5A is a diagram of a second exemplary ratcheting adjustment mechanism of the present invention.
Figure 5B:
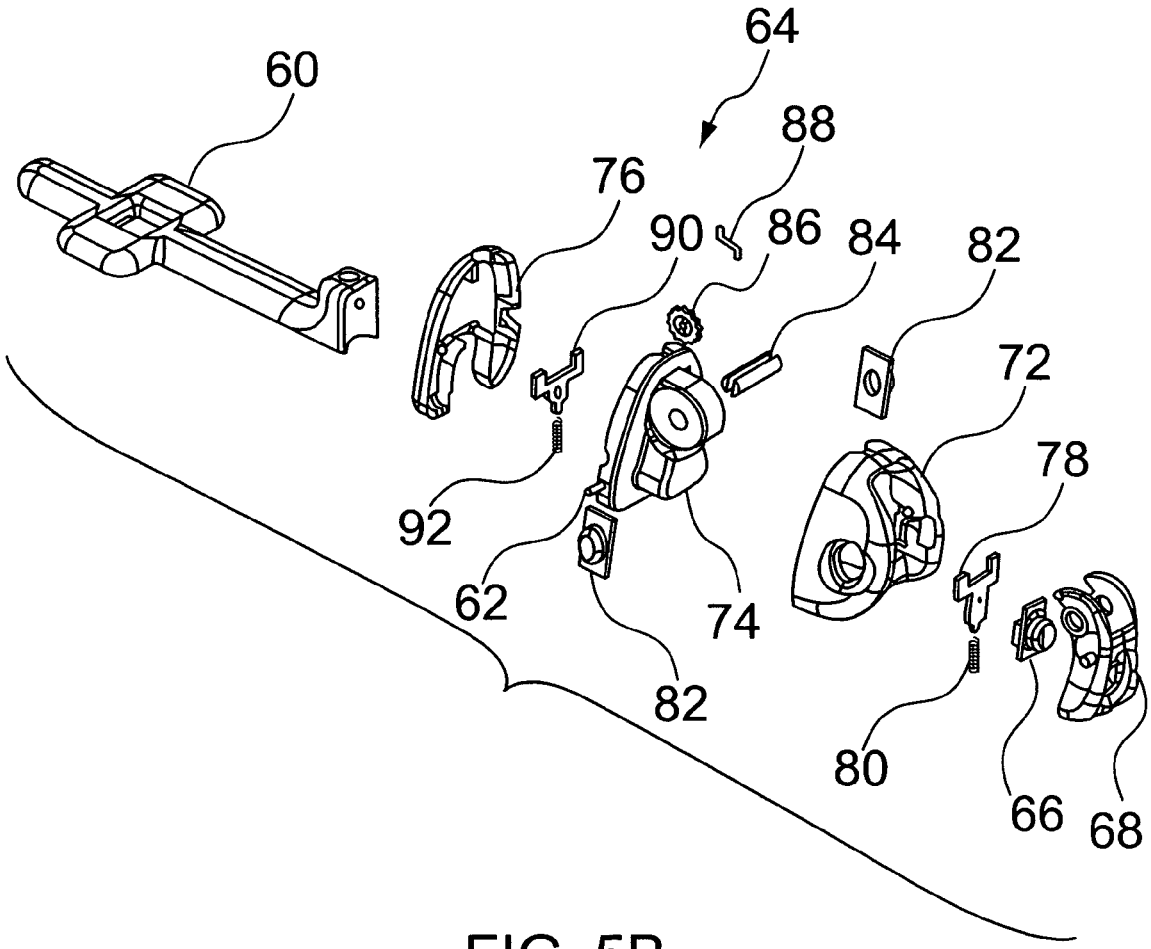
FIG. 5B is an exploded view of the second exemplary adjustment mechanism of the present invention.

Alternatively, a more complicated mechanism can be utilized, such as the one shown in FIGS. 5A and 5B. The mechanism 56 includes a foot 60 as a base. The mechanism 56 also includes a strap tensioner 62 in communication with the connecting material 6, which provides releasable attachment of the mechanism 56 with the connection material. The strap tensioner 62 can be a clamp or other element that grips the connecting material 6 by way of friction or grasping implements. The mechanism 56 can further include a ratchet device 64 in communication with the strap tensioner 62, to control travel of the connecting material 6 with respect to the mechanism 56. That is, the ratchet device 64 controls the direction and extent of travel of the gripped connecting material 6, in a manner known to those of skill in the art. A trigger device 66 with a handle 68 is also included, to actuate the ratchet device 64 to initiate travel of the connecting material 6.

The mechanism 56 includes a housing 70, including a shroud 72, shroud back 74, and back mounting plate 76, attached to the foot 60 and to the side panel. The shroud 72 houses a handle trigger 78 and trigger spring 80 for the trigger device 66, as well as a pair of housing triggers 82. The shroud back 74 provides a base for the strap tensioner 62 and elements of the ratchet device 64, such as the spindle 84, take up gear 86, and spindle pin 88. The shroud back 74 and back mounting plate 76 together house the shroud trigger 90 and trigger spring 92.

As an alternative, the connection pieces 10 can include a mounting plate 94 that is removably attached to one of the side panels 4, as shown in FIG. 2, such as by attachment to the end pieces of the frame 14. The mounting plate 94 can include apertures 96 through which the connecting material 6 passes, and a mechanism 98, such as a buckle or clamp, for fixing the connecting material 6 in place with respect to the mounting plate 94. The height of the mounting plate 94 with respect to the frame 14 can be fixed by selecting the point at which the mounting plate 94 is attached to the end pieces. Alternatively, the mounting plate 94 can include a mechanism for adjusting the position at which the mounting plate 94 is removably attached to the side panel.

Figure 8A:
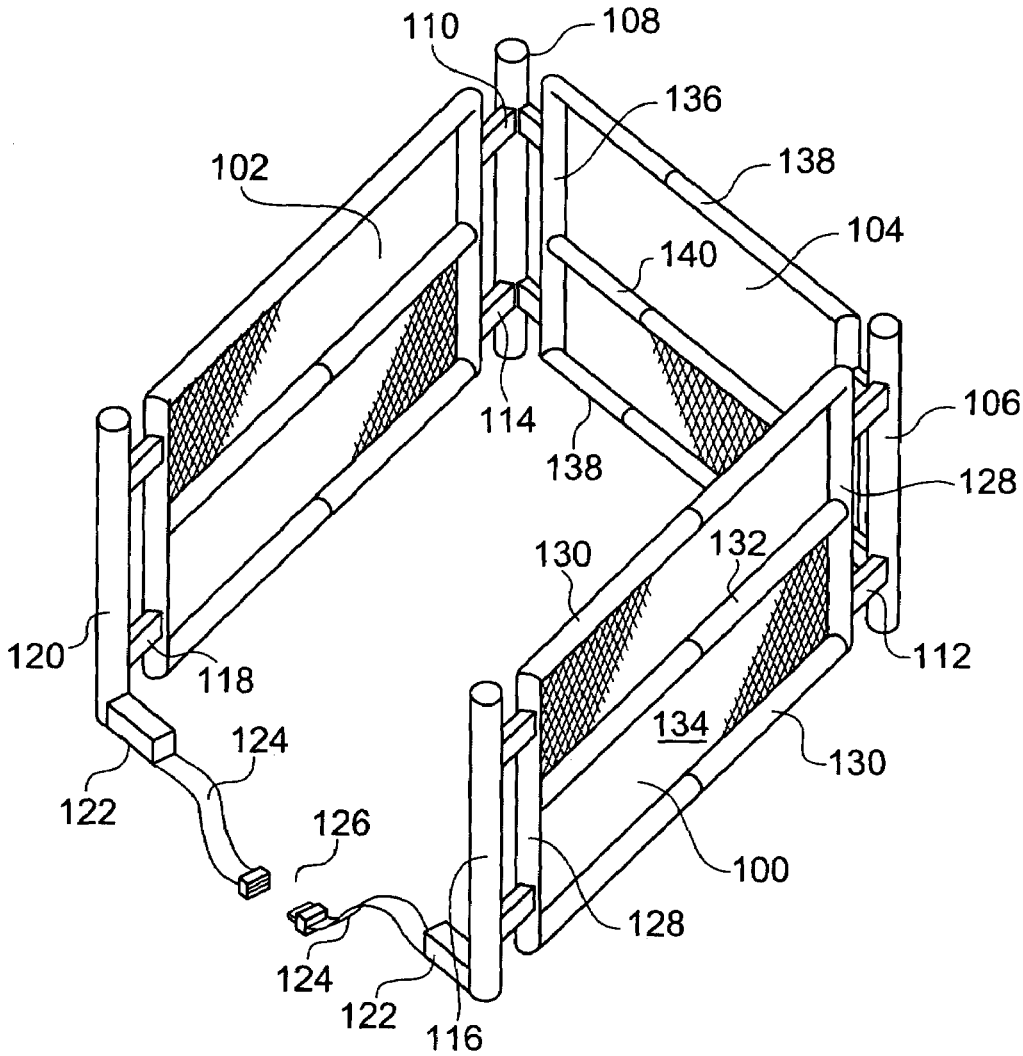
FIG. 8*a* is an illustration of an exemplary embodiment featuring two side panels and an end panel.

FIG. 8*a* shows an alternative embodiment of the present invention. As shown, this embodiment includes two side panels 100, 102 and an end panel 104. Alternatively, a single side panel 100 can be configured with the end panel 104. The side panels 100, 102 coupled to the end panel 104 at first and second posts 106, 108, respectively. Preferably, these posts 106, 108 provide a hinged connection between the respective panels, so that in an open position and assembled for use with a bed, the side panels 100, 102 face each other across the mattress, and the end panel 104 is oriented at the end of the bed, substantially perpendicular to the side panels 100, 102.

Figure 8B:
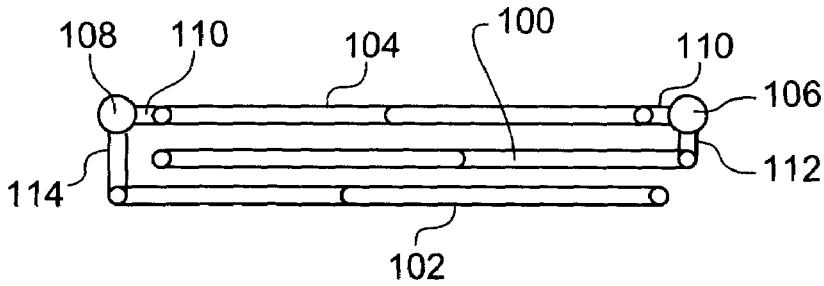
FIG. 8*b* is an illustration of the exemplary embodiment of FIG. 8*a*, in a folded arrangement.

Preferably, the panels 100, 102, 104 are connected to the posts 106, 108 by a number of spacers 110, 112, 114. These spacers 110, 112, 114 provide clearance such that when the assembly is removed from the bed, the panels 100, 102, 104 can be folded into a compact configuration. As shown in FIG. 8*b*, the spacers 112 connecting the end panel 104 to one side panel 100 preferably are shorter than the spacers 114 connecting the end panel 104 to the other side panel 102, so that in the folded configuration, the panels 100,102, 104 can be disposed substantially parallel to each other.

The assembly can also include third and fourth posts 116,120, preferably connected to the side rails 100, 102 by spacers 118. These posts 116,120 can include footings 122 to add stability to the bed guard when assembled on a bed. The posts 116, 120 are hingedly connected to the side panels 100, 102, so that in an open position, the footings 122 are oriented perpendicular to the side panels 100, 102, and in a closed position, the footings 122 are oriented parallel to the side panels 100, 102 for compactness.

Preferably, flexible connecting material 124, such as straps made of fabric webbing material, is attached to the footings on either side. These can be connected, for example, by a buckle 126 or other mechanism, which can also be used to take up slack in the connecting material 124, to provide stability for the bed guard when it is assembled on a bed.

The side panels 100, 102 and/or end panel 104 can be constructed of attached horizontal and vertical segments. For example, the side panel 100 can be constructed from two vertical segments 128 attached to three horizontal segments 130, 132. The horizontal segments shown include top and bottom segments that, along with the vertical segments 128, define the side panel 100. The interior horizontal segment 132 is an optional rigid horizontal member that spans the interior of the side panel 100 and can be connected directly to the vertical segments 128 or can be attached to fabric 134 that also spans the interior of the side panel 100.

The horizontal segments preferably are adjustable in length, so as to accommodate different sizes of beds and different purposes, and also in order to achieve a compact size for storage. In the exemplary embodiment shown, each horizontal member is constructed of a pair of concentric tubes, one of which slides inside the other to adjust the length of the overall segment. Each tube can be fixed in place through the use of fasteners attached to the tubes. One tube can include the fastener for application to the other tube, or each tube can include a mating half of the fastener. For example, the fasteners can be coupled to one tube of each pair, and the other tube can include one or more holes that communicate with the fasteners to fix the length of the horizontal segment. An exemplary fastener includes a spring portion and a button, such as a Valco®-type snap button. The spring portion provides a bias that pushes the button through a hole in the second tube to fix it in place. Multiple holes allow adjustment of the length of the horizontal members over a desired range. It is contemplated that the length would preferably range from about 30 inches to about 48 inches.

Likewise, the end panel 104 can be constructed of vertical segments 136, top and bottom horizontal segments 138, and an intermediate horizontal segment 140. The horizontal segments 138, 140 are preferably adjustable in the same manner as corresponding segments of the side panels 100, 102. It is contemplated that the length would preferably range from about 30 inches to about 56 inches, in order to adapt to beds as large as queen sized. In its most compact form, the bed guard assembly would have cross-sectional dimensions of 30 inches by 6 inches, and can be placed in a suitable carrying case for portability.

Particular exemplary embodiments of the present invention have been described in detail. These exemplary embodiments are illustrative of the inventive concept recited in the appended claims, and are not limiting of the scope or spirit of the present invention as contemplated by the inventors.

We claim:

1. A bed guard assembly, comprising:

at least one side panel;

an end panel coupled at a substantially right angle to the at least one side panel; and stabilizers for placement beneath a mattress, coupled to the at least one side panel;

wherein the at least one side panel includes a rigid outer side frame and fabric material attached to the rigid outer side frame; and wherein the end panel includes a rigid outer end frame and fabric material attached to the rigid outer end frame.

2. The bed guard assembly of claim 1, wherein the at least one side panel further includes a substantially horizontal rigid member spanning an interior of the outer side frame.

3. The assembly of claim 2, wherein the rigid outer frame includes substantially parallel opposing top and bottom members connected to substantially parallel opposing side members.

4. The assembly of claim 3, wherein the substantially horizontal rigid member is coupled to the substantially parallel opposing side members.

5. The assembly of claim 2, wherein the substantially parallel opposing top and bottom members and the substantially horizontal rigid member each made include a pair of removably connected rigid tubes.

6. The assembly of claim 5, wherein each pair of removably connected rigid tubes is slidably coupled together.

7. The assembly of claim 6, further comprising fasteners that fix a relative position of the respective pairs of removably connected rigid tubes in order to fix a length of the substantially parallel opposing top and bottom members and of the substantially horizontal rigid member.

8. The assembly of claim 7, wherein the fasteners include first fastener portions coupled to first tubes of each pair of removably connected rigid tubes; and second fastener portions coupled to second tubes of each pair of removably connected rigid tubes, which mate with corresponding first fastener portions to fix a relative position of the respective pairs of removably connected rigid tubes.

9. The assembly of claim 7, wherein the fasteners are coupled to first tubes of each pair of removably connected rigid tubes; and wherein second tubes of each pair of removably connected rigid tubes include apertures that communicate with the fasteners to fix a position of the first tubes of each pair of removably connected rigid tubes with respect to the second tubes of each pair of removably connected rigid tubes.

10. The assembly of claim 9, wherein each said fastener includes a spring portion and a button, wherein the spring portion provides a bias that pushes the button through a respective aperture in the second tube of the pair of removably connected rigid tubes to fix a length of the pair of removably connected rigid tubes.

11. The assembly of claim 10, wherein the fastener is a Valco®-type snap button.

12. The bed guard of claim 7, wherein the length of the substantially parallel opposing top and bottom members and of the substantially horizontal rigid member is adjustable in a range of 30 inches to 48 inches.

13. The bed guard assembly of claim 1, wherein the end panel further includes a substantially horizontal rigid member spanning an interior of the outer end frame.

14. The assembly of claim 13, wherein the rigid outer frame includes substantially parallel opposing top and bottom members connected to substantially parallel opposing side members.

15. The assembly of claim 14, wherein the substantially horizontal rigid member is coupled to the substantially parallel opposing side portions.

16. The assembly of claim 13, wherein the substantially parallel opposing top and bottom members and the substantially horizontal rigid member each include a pair of removably connected rigid tubes.

17. The assembly of claim 16, wherein each pair of removably connected rigid tubes is slidably coupled together.

18. The assembly of claim 17, further comprising fasteners that fix a relative position of the respective pairs of removably connected rigid tubes in order to fix a length of the substantially parallel opposing top and bottom members and of the substantially horizontal rigid member.

19. The assembly of claim 18, wherein the fasteners include first fastener portions coupled to first tubes of each pair of removably connected rigid tubes; and second fastener portions coupled to second tubes of each pair of removably connected rigid tubes, which mate with corresponding first fastener portions to fix a relative position of the respective pairs of removably connected rigid tubes.

20. The assembly of claim 18, wherein the fasteners are coupled to first tubes of each pair of removably connected rigid tubes; and wherein second tubes of each pair of removably connected rigid tubes include apertures that communicate with the fasteners to fix a position of the first tubes of each pair of removably connected rigid tubes with respect to the second tubes of each pair of removably connected rigid tubes.

21. The assembly of claim 20, wherein each said fastener includes a spring portion and a button, wherein the spring portion provides a bias that pushes the button through a respective aperture in the second tube of the pair of removably connected rigid tubes to fix a length of the pair of removably connected rigid tubes.

22. The assembly of claim 21, wherein the fastener is a Valco®-type snap button.

23. The bed guard of claim 18, wherein the length of the substantially parallel opposing top and bottom members and of the substantially horizontal rigid member is adjustable in a range of 30 inches to 56 inches.

24. The bed guard assembly of claim 1, wherein the at least one side panel is one side panel; and the stabilizers include at least one rigid side extension that extends from a bottom end of the side panel at a substantially right angle to a plane defined by the rigid outer side frame.

25. The bed guard assembly of claim 24, further including at least one rigid end extension that extends from a bottom end of the end panel at a substantially right angle to a plane defined by the rigid outer end frame.

26. The bed guard assembly of claim 1, wherein the at least one side panel is one side panel; and the stabilizers include at least one base element, and flexible connecting material attached to the at least one base element such that the side panel opposes the base element when the flexible connecting material is disposed beneath a mattress.

27. The bed guard assembly of claim 26, wherein the stabilizers further include a mechanism for decreasing the length of flexible connecting material disposed between each said base element and the side panel, to reduce slack in the flexible connecting material such that each said base element is pulled taut against a side of the mattress opposing the side panel.

28. The bed guard assembly of claim 27, wherein the mechanism is a buckle.

29. The bed guard assembly of claim 26, further including at least one rigid end extension that extends from a bottom end of the end panel at a substantially right angle to a plane defined by the rigid outer end frame.

30. The bed guard assembly of claim 1, wherein the at least one side panel is one side panel, and further including an upright post that couples the end panel to the side panel.

31. The bed guard assembly of claim 30, wherein the upright post provides a hinged connection between the end panel and the side panel.

32. The bed guard assembly of claim 31, wherein the end panel and the side panel are oriented at a substantially right angle when the hinged connection is in an open position.

33. The bed guard assembly of claim 31, further comprising a plurality of spacers, wherein each said spacer is attached to the upright post and to one of the end panel and the side panel so as to maintain a fixed distance between the upright post and each of the end panel and the side panel.

34. The bed guard assembly of claim 33, wherein the end panel and the side panel are oriented in substantially parallel planes when the hinged connection is in a closed position.

35. The bed guard assembly of claim 1, wherein the at least one side panel is a first side panel and a second side panel, wherein a first side of the first side panel is coupled to a first side of the end panel and a first side of the second side panel is coupled to a second side of the end panel.

36. The bed guard assembly of claim 35, wherein the stabilizers include at least one first rigid side extension that extends from a bottom end of the first side panel at a substantially right angle to a plane defined by the first rigid outer side frame, and at least one second rigid side extension that extends from a bottom end of the second side panel at a substantially right angle to a plane defined by the second rigid outer side frame.

37. The bed guard assembly of claim 36, wherein each said at least one first rigid side extension is connected to a respective one of the at least one second rigid side extensions.

38. The bed guard assembly of claim 36, further including at least one rigid end extension that extends from a bottom end of the end panel at a substantially right angle to a plane defined by the rigid outer end frame.

39. The bed guard assembly of claim 35, further including a first upright post that couples the end panel to the first side panel, and a second upright post that couples the end panel to the second side panel.

40. The bed guard assembly of claim 39, wherein the first and second upright posts provide hinged connections between the end panel and the respective side panels.

41. The bed guard assembly of claim 40, wherein the end panel is oriented at a substantially right angle with either of the first side panel and the second side panel when the corresponding hinged connection is in an open position.

42. The bed guard assembly of claim 40, further comprising a plurality of spacers, wherein each said spacer is attached to one of the first and second upright posts and to one of the end panel, the first side panels, and the second side panel so as to maintain a first fixed distance between the respective upright post and the end panel, a second fixed distance between the first upright post and the first side panel, and a third fixed distance between the second upright post and the second side panel.

43. The bed guard assembly of claim 42, wherein the end panel and the first and second side panels are oriented in substantially parallel planes when the hinged connections are in a closed position.

44. The bed guard assembly of claim 43, wherein one of the second fixed distance and the third fixed distance is greater than the other of the second fixed distance and the third fixed distance.

45. The bed guard assembly of claim 39, further comprising a third upright post coupled to a second side of the first end panel, and a fourth upright post coupled to a second side of the second end panel.

46. The bed guard assembly of claim 45, wherein the stabilizers are coupled to the first and second side panels by direct connection to the third and fourth upright posts.

47. The bed guard assembly of claim 46, wherein the stabilizers include a first flexible connection piece connected to the third upright post, and a second flexible connection piece connected to the fourth upright post.

48. The bed guard assembly of claim 47, further comprising at least one coupler attached to an end of at least one of the first flexible connection piece and the second flexible connection piece.

49. The bed guard assembly of claim 48, wherein the at least one coupler is a buckle.

50. The bed guard assembly of claim 46, wherein the third and fourth upright posts include respective first and second footings extending from the bottoms of the third and fourth upright posts at substantially right angles to the third and fourth upright posts, and wherein the stabilizers are connected to the first and second footings.

51. The bed guard assembly of claim 50, wherein the third and fourth upright posts have hinged connections to the first and second side panels, respectively.

52. The bed guard assembly of claim 51, wherein each said footing is oriented at a substantially right angle with the respective coupled side panel when the corresponding hinged connection is in an open position.

53. The bed guard assembly of claim 51, wherein each said footing is oriented in a substantially parallel plane with the respective coupled side panel when the corresponding hinged connection is in a closed position.

* * * * *